United States Patent [19]

Moorefield

[11] Patent Number: 4,848,819

[45] Date of Patent: Jul. 18, 1989

[54] SNOW RAKE

[76] Inventor: Frank R. Moorefield, 820 W. 46th St., Richmond, Va. 23225

[21] Appl. No.: 236,849

[22] Filed: Aug. 26, 1988

[51] Int. Cl.[4] ..... E01H 5/02

[52] U.S. Cl. ..... 294/54.5

[58] Field of Search ..... 294/54.5, 53.5, 49, 294/51, 52, 56, 57, 58, 50.8; 15/144 A; 37/53; 56/400.04, 400.18, 400.19; 172/372

[56] References Cited

U.S. PATENT DOCUMENTS 2,639,454 5/1953 Dory ..... 294/54.5

4,550,943 11/1985 Mirto ..... 294/54.5

*Primary Examiner*—James B. Marbert

*Attorney, Agent, or Firm*—Staas & Halsey

[57] ABSTRACT

A snow rake with a blade and a handle. The primary use is an improved means of removing snow from vehicles such as automobiles, vans, trucks, buses, etc. By taking the handle of the rake in one hand and dropping the blade into the snow on a vehicle, the user pulls the rake toward him and the snow is removed quickly and easily without damaging the surface of the vehicle. The length of the handle allows the snow to fall to the ground and not on the user.

1 Claim, 2 Drawing Sheets

SNOW RAKE

SUMMARY

This invention relates to an improvement in the removal of snow from the surface of vehicles such as automobiles, vans, trucks, buses, etc. There are various types of objects people use to remove snow from vehicles, some of which are brooms, sponge mops, squeegees, ice scrapers and sticks. These objects are time consuming and hard to use. They also can damage the surface of a vehicle.

The invention is made of two parts, a blade and a handle. In combination, the invention will remove snow from a vehicle quickly and easily. By holding the end of the handle in one hand, the user drops the blade into the snow on a vehicle and pulls the snow off with a minimum amount of effort. The handle is of a sufficient length so that the snow being removed will fall to the ground and not on the user. This invention can be used on the entire body of a vehicle, including the windshield and all windows. The invention will not damage the surface of a vehicle.

DETAILED DESCRIPTION OF THE INVENTION

Figure 1:
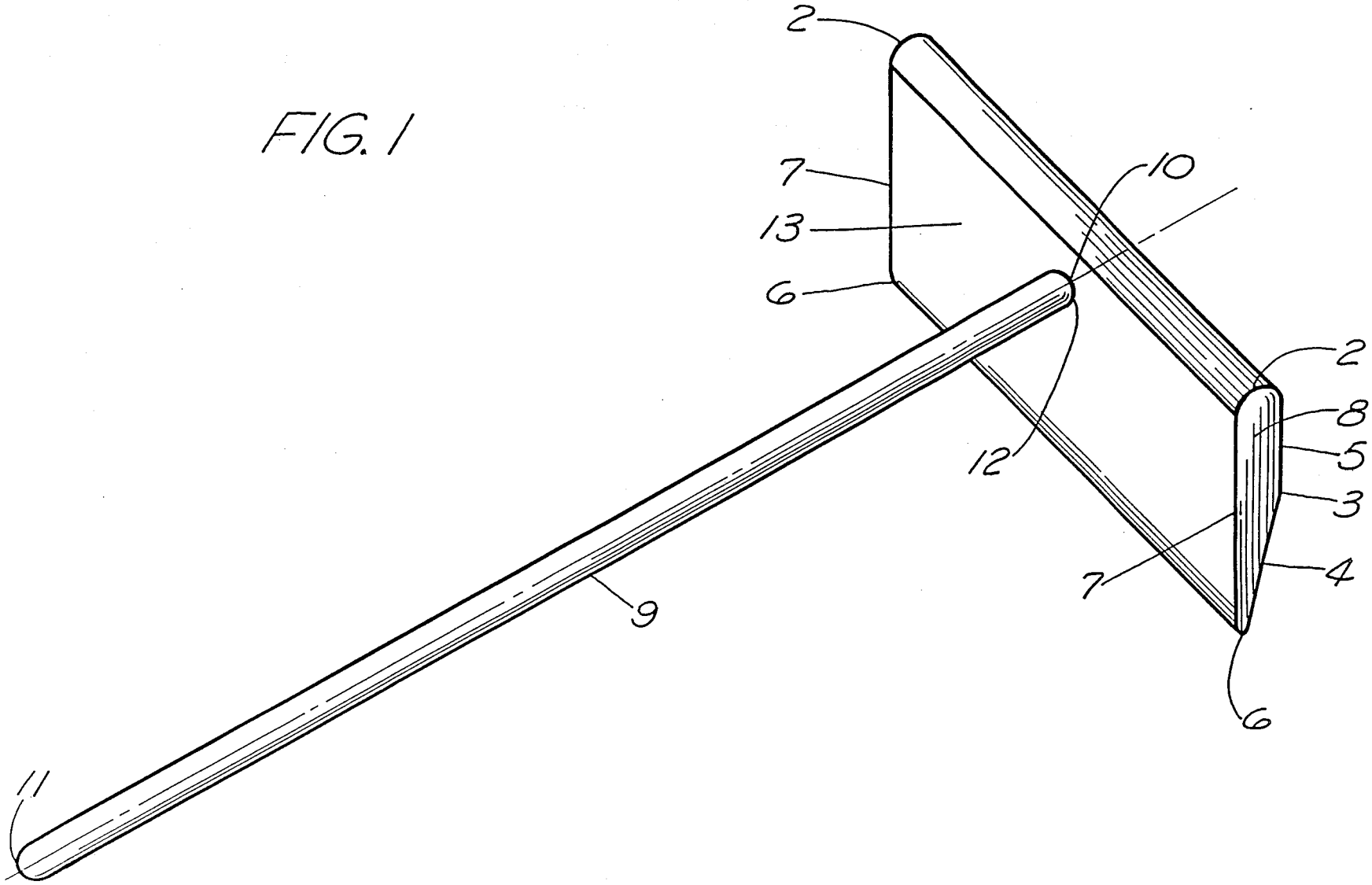
FIG. 1 is a perspective view of the invention showing in combination the blade and the handle.
Figure 2:
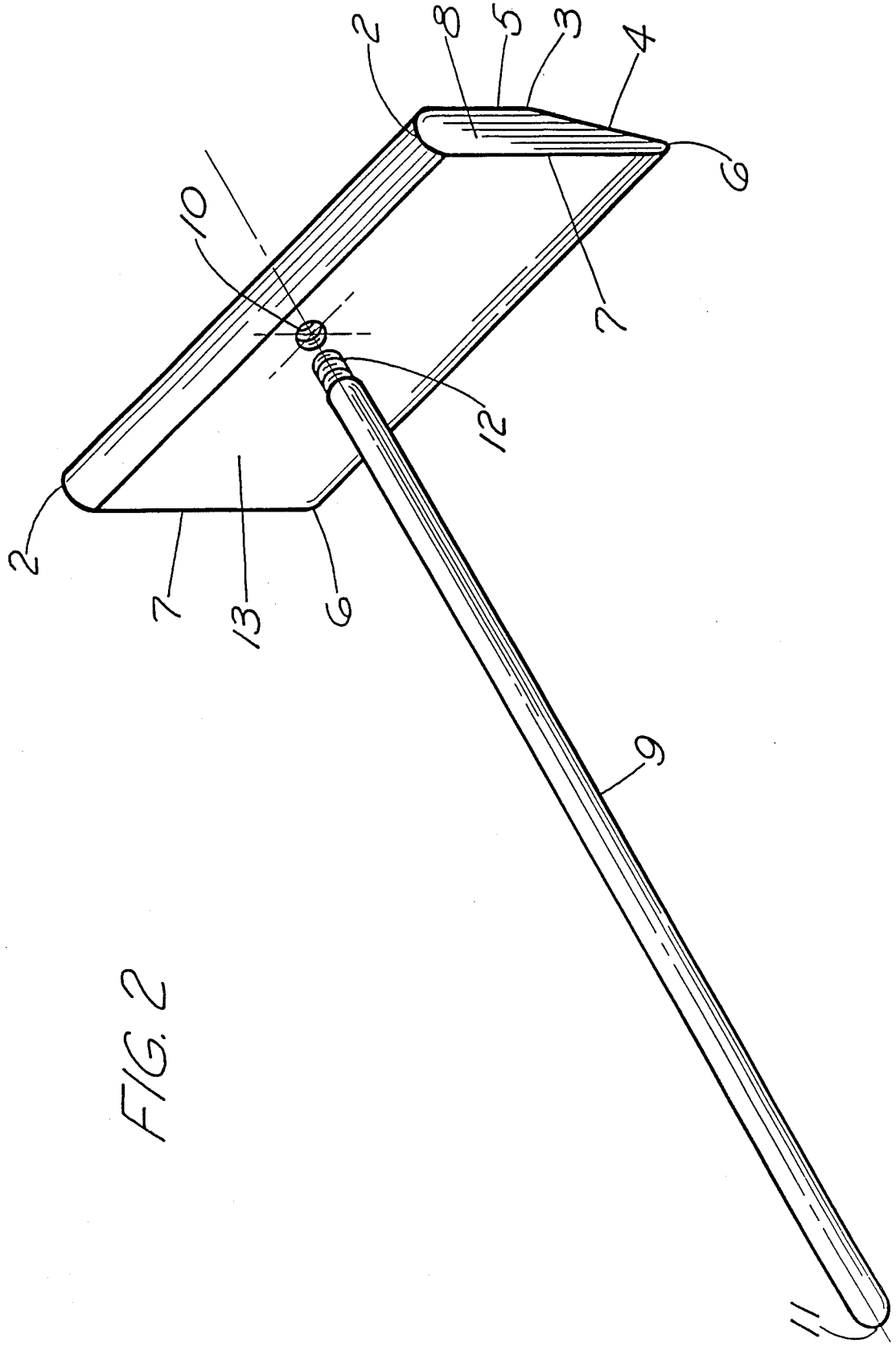
FIG. 2 is a perspective view of the invention showing the blade and the handle separated to show the threaded hole in the blade and the threaded end of the handle.

Referring to FIG. 1, the back of the blade 13 is a flat surface that goes across the width from 7 to 7 and down the height from the rounded top to the bottom edge 6. The thickness at 8 of the blade 13 remains constant from the rounded top 2 to 2 down to 3 between 7 and 5. The tapered section 4 starts at 3 and continues to taper down in thickness to the bottom edge 6 to 6, which is a rounded surface. At the center and near the top of the blade 13, there is a threaded hole 10 (FIG. 2). The handle 9 has threads 12 at the top (FIG. 2) and the bottom end 11 of the handle 9 is rounded.

Referring to FIG. 2 showing the blade 13 and the handle 9 separated, this view of the invention shows the threaded hole 10 at the center and near the rounded top 2 to 2 of the blade 13. It also shows the threading 12 at the top of the handle 9.

Sections 4 and 5 constitute the front side of the blade 13.

This invention can be manufactured in several ways. The handle 9 can be made of plastic or wood. The blade 13 can be made of plastic or some type of synthetic rubber.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

What is claimed is:

1. A snow rake for removing the snow from the surface of vehicles comprising:

a rectangular blade made of plastic or synthetic rubber having a width, height, back, front, rounded top and bottom rounded edge;

said rectangular blade having a top portion of constant thickness with a front flat surface extending below said rounded top and a bottom tapered portion having a thickness tapering down to said bottom rounded edge;

a threaded hole in said rectangular blade at the center of said width of said rectangular blade and near said rounded top of said rectangular blade; and an elongated handle sufficiently long for the snow to be raked to the side of a vehicle to fall on the ground and not on the user and having a threaded end adapted to be screwed in said threaded hole of said rectangular blade.

* * * * *